US007322848B2

(12) United States Patent
Hatton

(10) Patent No.: US 7,322,848 B2
(45) Date of Patent: Jan. 29, 2008

(54) PAPERLESS PICKING SYSTEM

(75) Inventor: Gerry Hatton, Frenchs Forest (AU)

(73) Assignee: Dematic Corp., Grand Rapids, MI (US)

( * ) Notice: Subject to any disclaimer, the term of this patent is extended or adjusted under 35 U.S.C. 154(b) by 1077 days.

(21) Appl. No.: 10/407,396

(22) Filed: Apr. 4, 2003

(65) Prior Publication Data

US 2003/0207609 A1 Nov. 6, 2003

Related U.S. Application Data

(63) Continuation of application No. 09/161,151, filed on Sep. 25, 1998, now Pat. No. 6,544,068.

(51) Int. Cl.
*H01R 13/56* (2006.01)

(52) U.S. Cl. ..... 439/425; 414/786

(58) Field of Classification Search ..... 439/425; 414/786

See application file for complete search history.

(56) References Cited

U.S. PATENT DOCUMENTS

| | | | | | |
|---|---|---|---|---|---|
| 2,313,960 | A | | 3/1943 | O'Brien | 173/334.1 |
| 3,613,910 | A | * | 10/1971 | Weir | 414/281 |
| 3,916,089 | A | | 10/1975 | Sloan | 174/164 |
| 4,719,694 | A | * | 1/1988 | Herberich et al. | 29/703 |
| 4,792,273 | A | * | 12/1988 | Specht | 414/807 |
| 4,820,101 | A | * | 4/1989 | Fenn | 414/21 |
| 4,921,087 | A | * | 5/1990 | Nakamura | 198/350 |
| 5,054,601 | A | * | 10/1991 | Sjogren et al. | 198/370.04 |
| 5,447,450 | A | | 9/1995 | Woodward et al. | 439/417 |
| 5,453,022 | A | | 9/1995 | Staiger et al. | 439/404 |
| 5,509,538 | A | * | 4/1996 | Spindler et al. | 209/630 |
| 5,756,933 | A | | 5/1998 | Pitchford et al. | 174/48 |
| 5,855,491 | A | | 1/1999 | Hintner et al. | 439/409 |
| 5,934,930 | A | | 8/1999 | Camps et al. | 439/425 |
| 5,943,841 | A | * | 8/1999 | Wunscher | 53/154 |
| 5,959,394 | A | | 9/1999 | Lin | 313/318.1 |
| 5,997,338 | A | | 12/1999 | Pohjola | 439/425 |
| 6,045,373 | A | | 4/2000 | Hardt | 439/98 |
| 6,196,863 | B1 | | 3/2001 | Schwant | 439/417 |
| 6,544,068 | B1 | | 4/2003 | Hatton | |

* cited by examiner

*Primary Examiner*—Thanh-Tam Le
(74) *Attorney, Agent, or Firm*—Van Dyke, Gardner, Linn & Burkhart, LLP

(57) ABSTRACT

A paperless picking system for use in a product distribution center includes multiple bays of product supports and operator interfaces, at least one of which is at the bays. The product supports include case flow racks, pallet racks and/or product shelving. The operator interface devices are data displays and/or pick confirmation input devices. A picking data management computer system receives data from the pick confirmation input devices and provides data to the data displays. A plurality of mounting rails are provided, each of which is at one of the multiple bays. The mounting rails support at least one data line. Each of the picking devices includes a housing. Electrical connection is established between the picking devices and the at least one data line as a result of the housing being supported by one of the mounting rails. In this manner, the at least one data line provides data exchange between the data management computer system and the operator interface devices throughout a range of physical locations of the operator input devices and the paperless picking system can be configured by physically moving the operator interface devices.

13 Claims, 11 Drawing Sheets

PAPERLESS PICKING SYSTEM

CROSS REFERENCE TO RELATED APPLICATIONS

This application is a continuation of U.S. patent application Ser. No. 09/161,151, filed on Sep. 25, 1998, now U.S. Pat. No. 6,544,068, which claims priority from provisional patent application No. P09472, filed in Australia on Sep. 16, 1997, the disclosures of which are hereby incorporated herein by reference in their entireties.

FIELD OF THE INVENTION

This invention pertains to picking systems and more particularly to a paperless, order assembly system.

BACKGROUND OF THE INVENTION

Distribution centres typically utilise order picking systems for the purpose of assembling their customer's orders. In modern distribution centres, order picking has been made paperless, at least to the person manually picking orders. A modern paperless picking system has numerous advantages; it allows the picker to use both hands, is more accurate, tracks productivity and generates reports, maintains products statistic, offers accountability and improves inventory management. Prior art paperless picking systems may, for example, revolve around a central system controller (computer) which interfaces with a customer's host computer, one or more monitors and a series of "second level devices" or section controllers which manage picking zone level activities. The section controllers in turn, control picking bay level and picking slot or location level devices. Each pick location or slot is identified by one of a family of devices which are positioned throughout the picking area giving order information to the pickers and providing an interface for peripheral devices such as scanners. Zone level information is transmitted to the picker and received from the picker by any number of electronic devices.

Zone and location level devices are generally capable of displaying pick data, acquiring pick confirmation data, displaying quantity adjustment and quantity recall, or other functions which may be relevant to the order picking job at hand. In addition, each pick zone including multiple bays of case flow racks, pallet racks or shelving may be associated with a zone panel. The zone panel in prior art systems is located in each zone and displays order numbers, number of picks, scrolled messages and other textual information. The zone panel may also provide access to diagnostic functions and serves as a back up to the slot displays Pickers can adjust their routes according to directions from the zone panel display.

Paperless order assembly systems of the type described above are popular in modem distribution centres. However, the hardware and hardware installation associated with paperless picking systems can be improved. Individual slot level devices are centrally networked together and hence repositioning of a slot device requires a rewiring of that portion of the network to which the relocated slot level device belongs. Further, the network cabling extending between slot level devices must be shielded, requiring a certain degree of customisation for every slot level device installed or relocated. Thus the job of installing or relocating the slot level devices is both time-consuming and expensive.

OBJECT OF THE INVENTION

It is an object of the present invention to provide a paperless order assembly system and apparatus therefor which facilitates installation and reconfiguration, or at least provides a viable alternative to existing paperless systems.

SUMMARY OF THE INVENTION

Accordingly, a first aspect of the present invention provides an elongate support rail and a location or zone level data device, the support rail having a plurality of longitudinally extending spaced apart channels formed therein, each channel defining an opening into which may be inserted one or more lengths of insulated conducting wire, the location or zone level data device attachable to a front face of the rail, the device having a plurality of penetrating pins corresponding generally in lateral spacing to the channels in the support rail, the pins being adapted to penetrate the insulation of the wire with the device in an operational position, thereby to provide an electrical connection between the device and the wire at selected locations on the support rail.

A further aspect of the present invention provides a paperless picking system including an elongate support rail having a plurality of longitudinally extending spaced apart channels formed therein, each channel defining an opening into which may be inserted one or more lengths of insulated conducting wire, a location or zone level data device attachable to a front face of the rail, the device having a plurality of penetrating pins corresponding generally in lateral spacing to the channels in the support rail, the pins being adapted to penetrate the insulation of the wire with the device in an operational position, thereby to provide an electrical connection between the device and the wire at selected locations on the support rail.

A yet further aspect of the present invention provides an elongate support rail for use in a paperless picking system, said support rail having a plurality of longitudinally extending spaced apart channels formed therein, each channel defining an opening into which may be inserted one or more lengths of insulated conducting wire, said support rail adapted to receive a location or zone level data device on a front face of the rail, the device having a plurality of penetrating pins corresponding generally in lateral spacing to the channels in the support rail, the pins being adapted to penetrate the insulation of the wire with the device in an operational position, thereby to provide an electrical connection between the device and the wire at selected locations on the support rail.

A yet further aspect of the present invention provides a location or zone level data device for a paperless picking system, said device adapted to be attachable to a front face of an elongate support rail having a plurality of longitudinally extending spaced apart channels formed therein, each channel defining an opening into which may be inserted one or more lengths of insulated conducting wire, said device having a plurality of penetrating pins corresponding generally in lateral spacing to the channels in the support rail, the pins being adapted to penetrate the insulation of the wire with the device in an operational position, thereby to provide an electrical connection between the device and the wire at selected locations on the support rail.

In a preferred embodiment, the devices are configured so as to resist inverted positioning with respect to the rail. In another preferred embodiment, the number of penetrating pins on the device is at least twice the number of channels in the rail. The insulation is preferably self-healing and the wire is preferably multi-stranded.

The present invention has particular application in relation to paperless, light-directed order assembly systems which utilise distributed control architecture.

BRIEF DESCRIPTION OF THE DRAWINGS

Preferred embodiments of the invention will now be described, by way of example only, with reference to the accompanying drawings in which:

FIG. 15(*b*) is a bottom view of the support rail and data device shown in FIG. 15(*a*);

FIG. 15(*c*) is a top view of the support rail and data device shown in FIG. 15(*a*);

FIG. 15(*d*) is a cross-sectional view of the support rail and data device taken through plane AA in FIG. 15(*a*);

FIG. 15(*e*) is a cross-sectional view of the support rail and data device taken through plane BB in FIG. 15(*a*);

FIG. 16(*b*) is a bottom view of the support rail and data device shown in FIG. 16(*a*);

FIG. 16(*c*) is a top view of the support rail and data device shown in FIG. 16(*a*);

FIG. 16(*d*) is a cross-sectional view of the support rail and data device shown in FIG. 16(*a*) taken through plane AA in FIG. 16(*a*);

FIG. 16(*e*) is a cross-sectional view of the support rail and data device shown in FIG. 16(*a*) taken through plane BB in FIG. 16(*a*); and FIG. 16(*f*) is a side view of the support rail and data device depicted in FIG. 16(*a*).

PREFERRED EMBODIMENTS OF THE INVENTION

The following disclosure pertains to a physical data and power network which includes a convenient way of fastening and connecting physical devices which operate by means of this network. The broad means of physical and electrical connection of the devices to the network is essentially common to all of the devices in this disclosure, which are provided as examples of a family of such devices.

Modern distribution centres utilise a network of electronic devices for managing order picking operations. Human pickers are guided to zones, bays and individual locations for picking, by light emitting devices. These same devices can provide the pickers with valuable data and collect data from the pickers. The devices, the cabling interconnecting the devices and the computers that manage and record data etc., form a paperless picking system network. Electrically, the devices and the computer(s) are connected together by copper wire. The present invention strives to reduce the number of discontinuities or interruptions in the copper wire component of the network. At the same time, this approach provides flexibility and ease of use and maintenance.

Figure 1:
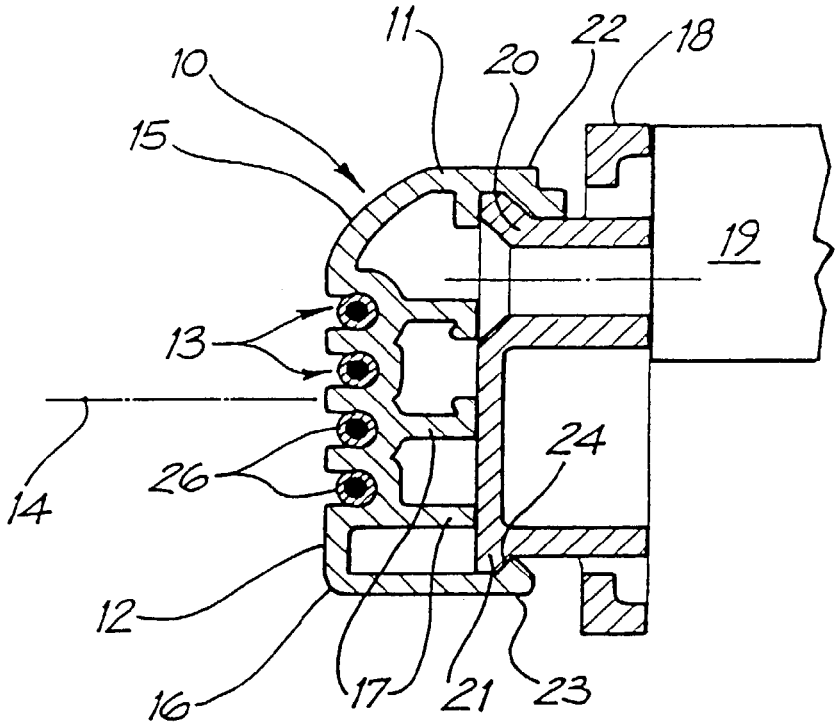
FIG. 1 is a cross-sectional view of a support rail according to the present invention affixed to an adaptor.

As shown in FIG. 1, a rail section 10 for a paperless picking system comprises an extruded aluminium rail 11. The rail 11 includes a front surface 12 preferably including four channels 13. Each channel 13 is adapted to snugly receive a length of insulated, "self-healing" multi-strand copper wire. The insulated multi-strand wire is for example, "Silivolt-E" brand cable from Isola Breitenbach. From the cross-sectional view of FIG. 1 it will be appreciated that the rail is not symmetrical about its longitudinal centre line 14. In this particular example, this asymmetry is manifested as an upper edge 15 which is radiused to a greater degree than the lower edge 16. Internal webs 17 serve to position the rail with respect to a support bracket 18. The support bracket 18 facilitates the attachment of the rail to, for example, a length of shelving 19. The bracket 18 may include upper and lower flanged edges 20, 21. Specially adapted rear edges 22, 23 of the rail are capable of resiliently engaging and retaining the rail on the bracket. To install a rail, the rear upper edge may be first inserted up and over the upper flanged edge 20 of the bracket. Then, the lower rear edge 23 of the rail is pushed over the lower flanged edge 21 of the bracket. As the lower edge 23 of the rail 10 is resiliently deformable and includes an inner ramped surface 24, the edge 23 slides up and over the flange 21. Retained by the edges 22, 23, the bracket is urged into position against the internal web 17 for a snug and secure fit.

Figure 2:
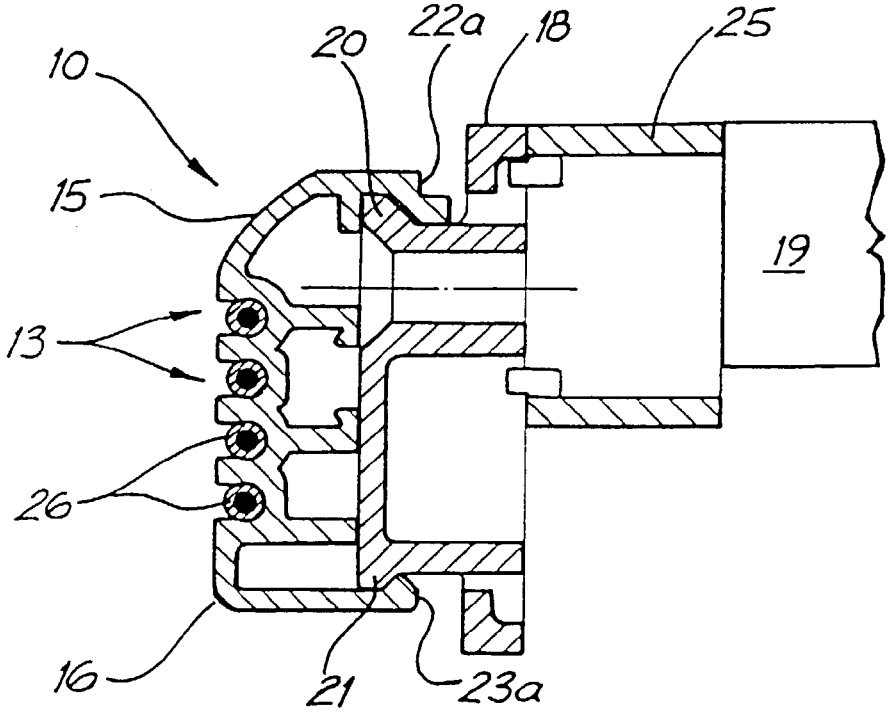
FIG. 2 is a cross-sectional view of the device depicted in FIG. 1 when attached to a spacer.

FIG. 2 illustrates that a spacer 25 may be required in order to compensate for a portion of a shelf etc., which forms a gap with respect to the bracket 18. In some instances it may be preferred to have an insulating spacer 25 so that in conjunction with an insulating bracket 18 the metallic rail 10 maintains electrical contact with the shelf 19. Note that the rear extremities of the rail 10 provide edges 22*a*, 23*a* which are used to retain any number of individual devices as will be explained below.

Figure 3:
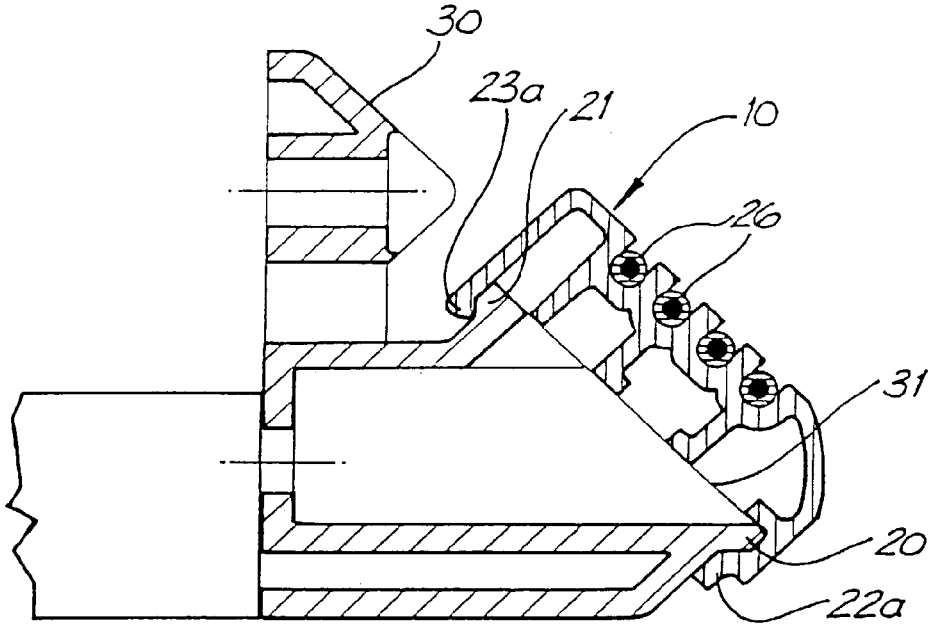
FIG. 3 is an invertible 45° angle adaptor fitted with a support rail according to the present invention.

FIG. 3 illustrates a mounting bracket 30 which includes an inclined surface 31 for mounting the rail 10. The bracket 31 includes the same flanged edges 20, 21 as seen in the devices depicted in FIGS. 1 and 2. It will be appreciated that the bracket 30 may be inverted so that the rail 10 may be presented to the user either facing upwardly or downwardly.

In practice, the rail 10 as depicted in FIGS. 1-3 is provided in 2 meter lengths which are convenient for shipping. However, the shelving or bays to which the rails are fitted are often considerably longer. For this reason, mechanical connectors are provided which allow individual extruded rail segments 11 to be mechanically joined. Once rail segments are joined into a length they are ready to accept the insulated wire 26 which is retained by slight interference or friction between the wire 26 and the channel 13. The purpose of this rail 10, channel 13 and wire 26 arrangement is to accept a mechanical and electrical inter-connection with any of a variety of modular zone level devices, bay level devices or location level devices.

It has been observed that the combination of aluminium rail and wire depicted above actually provides better electronic shielding than prior art devices even though the wire 26 is not fully concealed by the rail 10.

Figure 4:
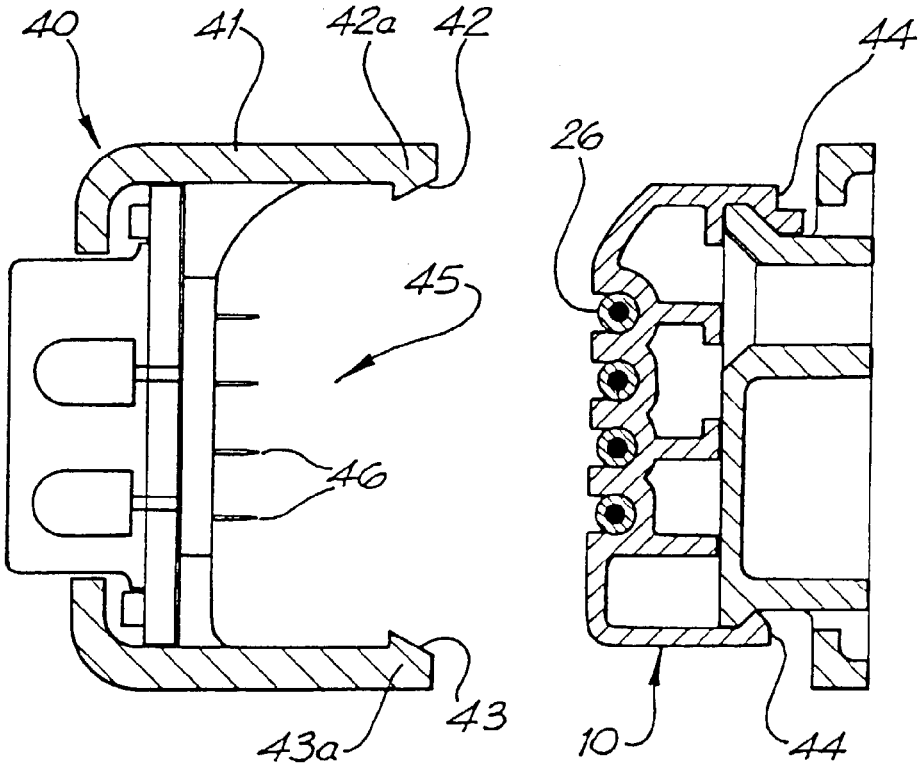
FIG. 4 is a cross sectional view of a device with penetrating pins and a support rail according to the present invention, the device being in proper position for installation.

As shown in FIG. 4, a typical location level device 40 comprises a channel-like body 41 which fits over and clamps snugly onto the rail 10. Upper and lower jaws 70, 71 of the device 40 allow the sides to open slightly as it rides up and over the rail 10, thereafter closing to positively engage or clamp the device with respect to rail 10. Ramped surfaces 42, 43 define teeth 42*a*, 43*a* for retaining the device in position.

Figure 4A:
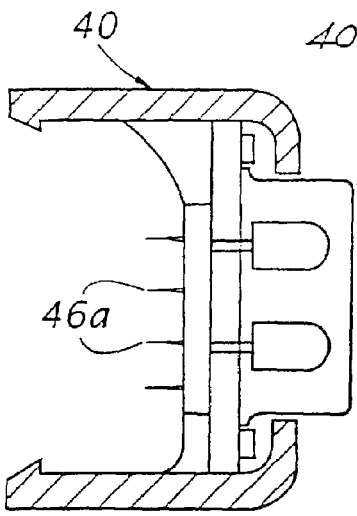
FIG. 4*a* is an opposite cross sectional view of the device with penetrating pins.

Within the channel-like body 41 there is located at least one vertical row of penetrating pins 45, with the pin spacing corresponding to the wire spacing. Preferably the number of pins is at least equal in number to the number of channels in the support rail. When the device 40 is installed correctly on the rail 10, each of the individual pins 46 penetrates the insulation of a wire 26 and makes electrical contact with a multi stranded core. Two or more vertical rows of spaced pins 46 may be provided allowing a certain degree of redundancy in the electrical connection to the rail. Referring to FIG. 4*a*, a second vertical row of spaced penetrating pins 46*a* is shown. Pins 46*a* are disposed directly behind pins 46, and therefore not visible in FIG. 4.

In a preferred embodiment, the order of the four wires from top to bottom, is, for example, power, data in, data out and ground. It will therefore be appreciated that it is important that the device 40 not be capable of installation in an inverted position. This would have the effect of at least rendering the device 40 inoperative, if not damaging or destroying it.

Figure 5:
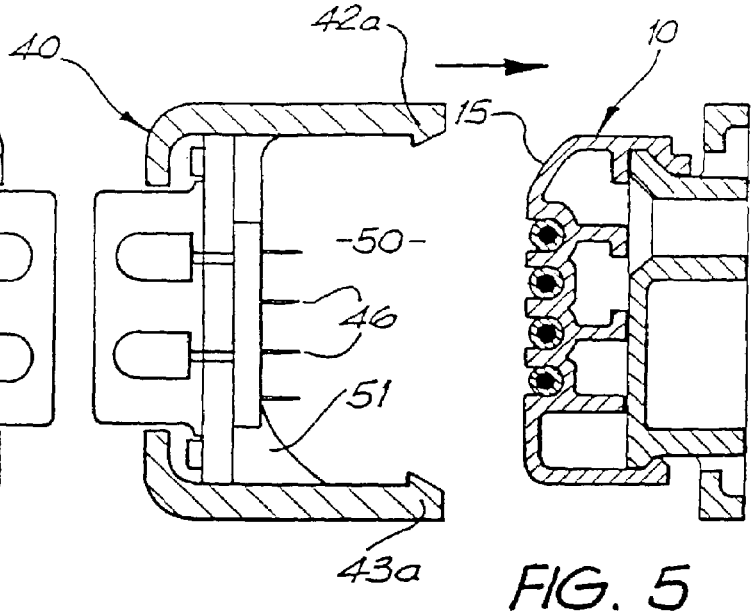
FIG. 5 is a cross-sectional exploded view of a device and rail, where the device is inverted.
Figure 6:
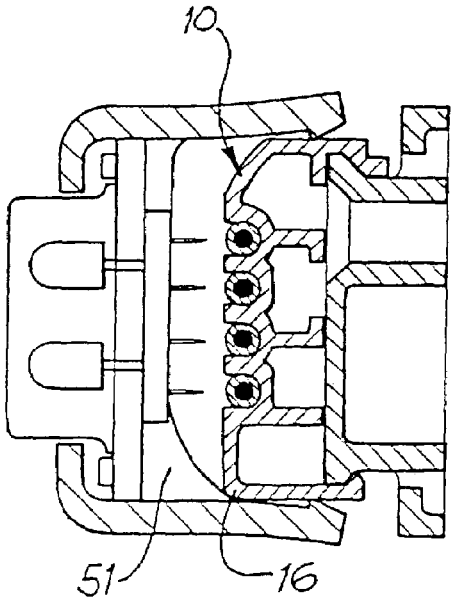
FIG. 6 illustrates an inverted device positioned over a rail, where proper installation is thwarted.
Figure 7:
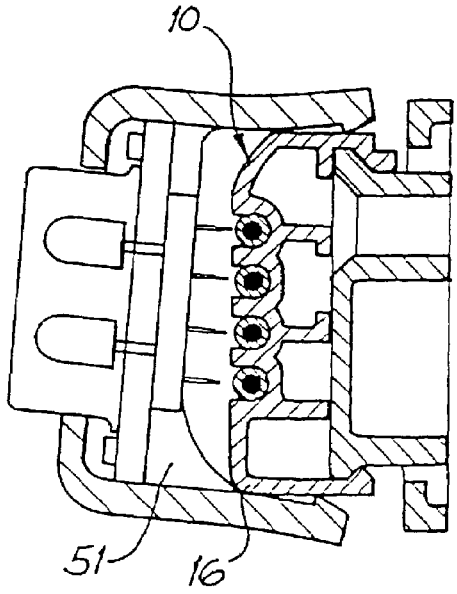
FIG. 7 illustrates the arrangement depicted in FIG. 6, further illustrating that the pins will not penetrate the insulation when the device is inverted.

Inverted installation of the device is prevented by having the interior 50 of the device 40 conform to the external shape of the rail 10. An interior web or wall section 51 is shaped to conform to the radiused upper edge 15 of the rail 10. Thus, as depicted in FIGS. 5-7 while it might be physically possible to place the device 40 partially over the rail 10, it is not possible to force the pins 46 into electrical contact with the wires 26. FIG. 6 illustrates maximum insertion along the bottom of the rail 10 and FIG. 7 illustrates a forcing along the topside of the rail. Because of the interference between the radius internal wall or web 51 and the bottom edge 16 of the rail 10, along with other factors such as the rigidity of the channel-like body 41 it is simply not possible to force the pins 46 into electrical contact when the device 40 is inverted.

Figure 8:
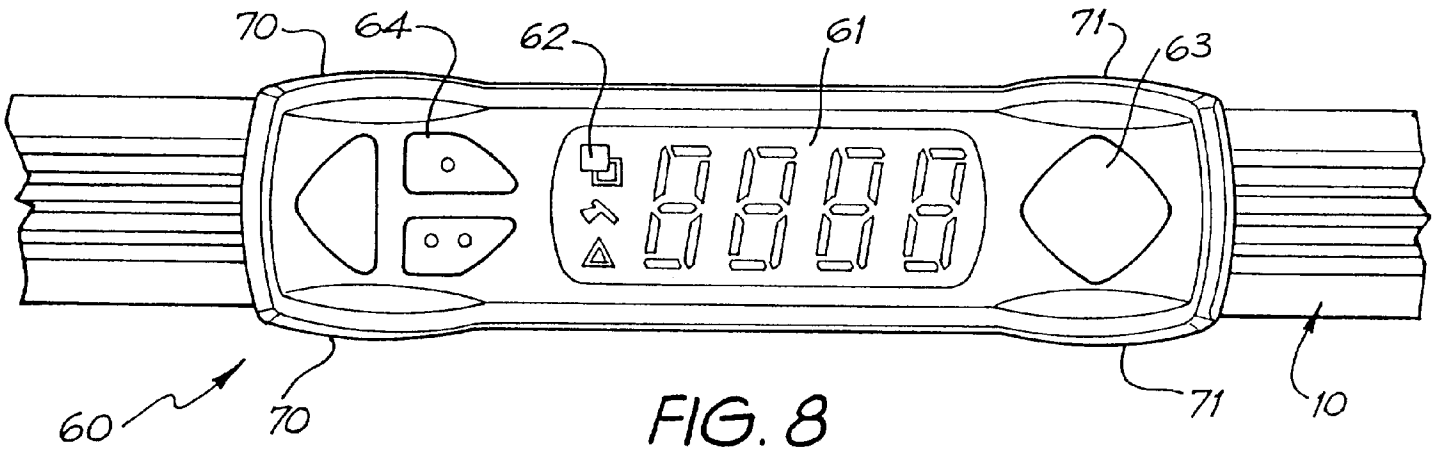
FIG. 8 is a front view of an integrated location level device for deployment at a pick location.
Figure 10:
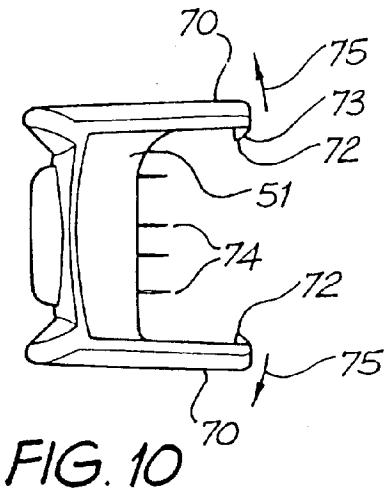
FIG. 10 is a side view of the device shown in FIG. 8.
Figure 9:
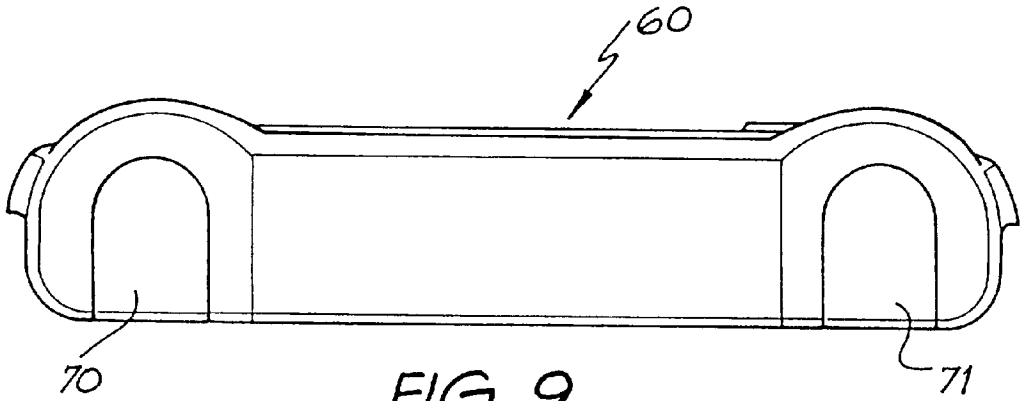
FIG. 9 is a bottom view of the device shown in FIG. 8.

As shown in FIG. 8, a location level device 60 may incorporate numerous functions including alpha numeric display 61, auxiliary indicators 62, data input button 63 and location indicators 64. This multi function location level device fits over the rail 10, only in the correct orientation as suggested by FIGS. 4-7. In preferred embodiments, and as shown in FIG. 9, the device 60 includes one or two pairs of resilient security jaws 70, 71. A single pair of jaws 70 or 71 is adapted to be grasped by one hand of the person installing the device 60. Each pair of jaws 70,71 (shown in FIG. 10) is biased into a closed or clamped position whereby retaining teeth 72 may engage rear surfaces 22*a*, 23*a* (see FIG. 2) of the rail and prevent the device 60 from accidental disengagement with the rail 10. The ramped surfaces 73 ride over the surface of the rail until the internal penetrating pins 74 pierce the insulation on the wires 26 and make electrical contact with the copper wire network. Because of the asymmetrical interior surface 51, the device 60 cannot be installed in an inverted position. To remove the device depicted in FIGS. 8-10, the device 60 must be gripped by both hands. Ideally, the user's left hand grips the left hand pair of jaws 70 while the right hand grips the right hand jaws 71. Pressure on both pairs of jaws 70, 71 simultaneously causes the teeth to separate in the direction of the arrows 75, thus removing any impediment to the removal of the device 60. Note that the device shown in side elevation in FIG. 10 only suggests four pins 74, one each dedicated to power input, data input, data output, and ground. A device of this size may be equipped with two or more vertical, parallel and similar rows of teeth 74 to provide or secure electrical contact, redundancy in the advent of failure and therefore extended operational life.

Figure 11A:
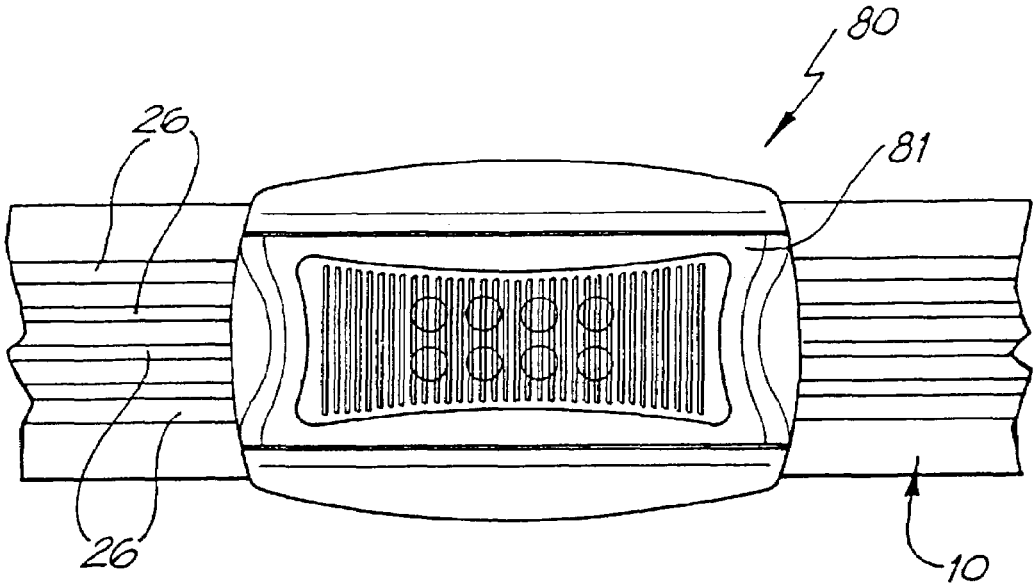
FIGS. 11(*a*) and (*b*) are front and bottom views of a zone indicator device.
Figure 11B:
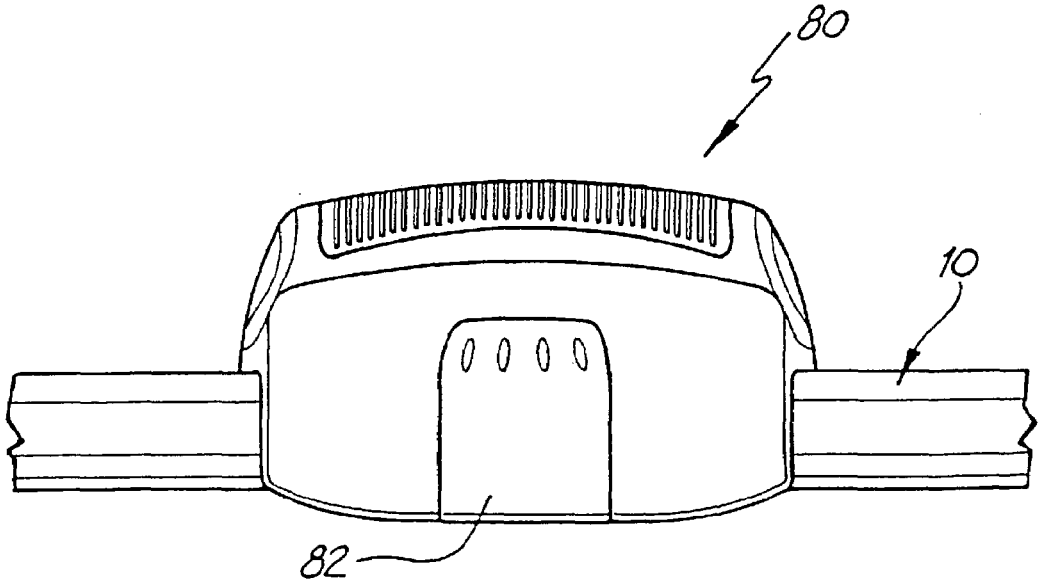

As shown in FIG. 11, a zone indicator of light 80 comprises a front panel 81 through which are visible light emitting display devices such as LEDs, LCDs, back-lit LCDs etc. The device receives data through an arrangement of pins (see FIG. 10) and displays data in the form of patterns, shapes or colours which indicate a particular zone for a worker to pick in. The device may incorporate a single pair of resilient jaws 82 for further securing the attachment of the device 80 to the rail 10.

Figure 12A:
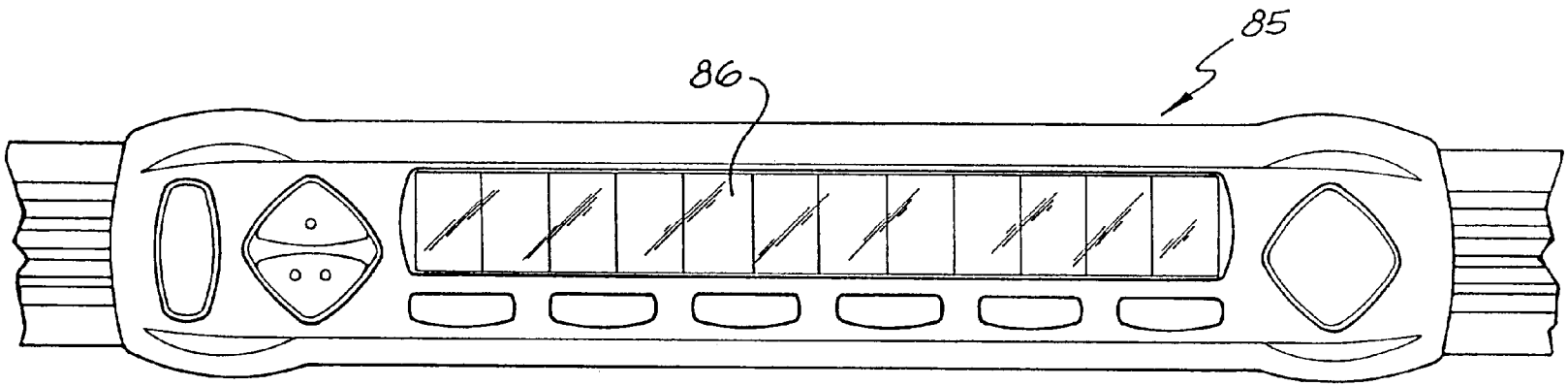
FIGS. 12(*a*) and (*b*) are front and bottom views of a multi-function bay controller device.
Figure 12B:
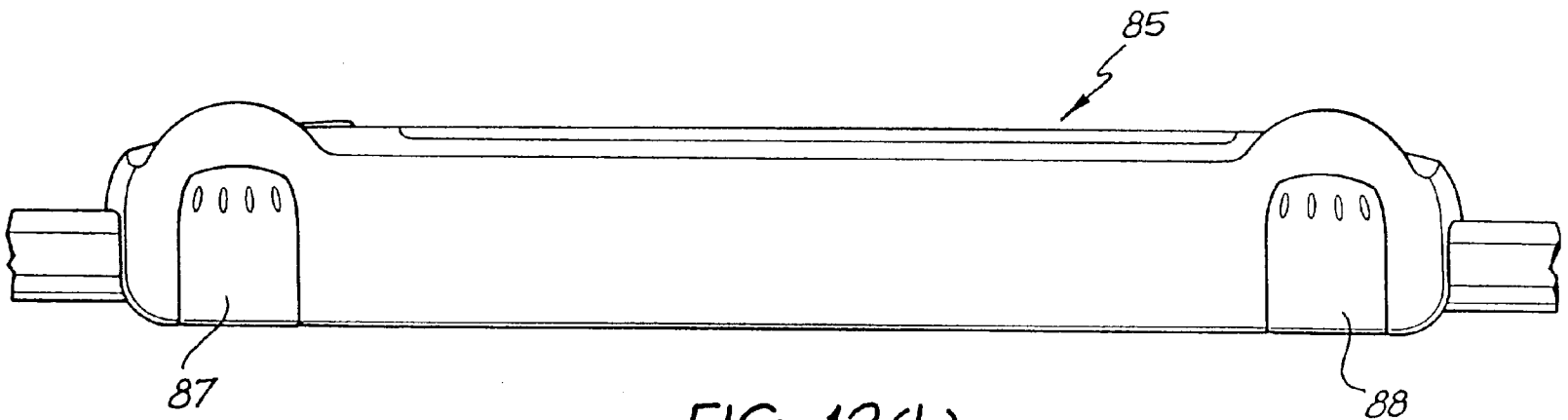

FIGS. 12(*a*) and (*b*) illustrates a considerably more sophisticated display and data input device 85 which incorporates many features normally associated with bay level device into a location level device. The device is capable of allowing an operator to input data as well as displaying a wide variety of data to the operator or picker. A large alpha-numeric display 86 facilitates the interaction and data exchange between the paperless picking system and the picker. Note that two pairs of resilient jaws 87,88 are provided to prevent inadvertent disengagement of the device from the rail.

Figure 13A:
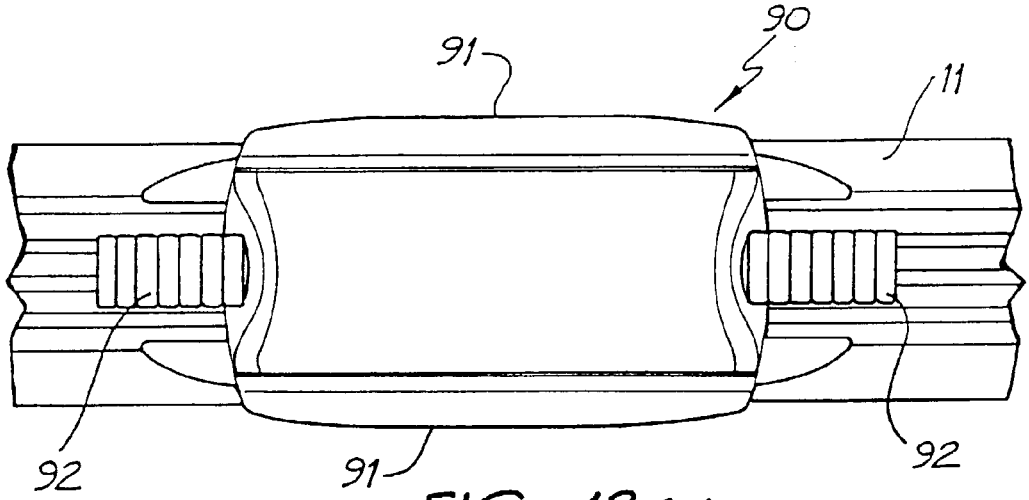
FIGS. 13(*a*) and (*b*) are top and side views of a split drive device.
Figure 13B:
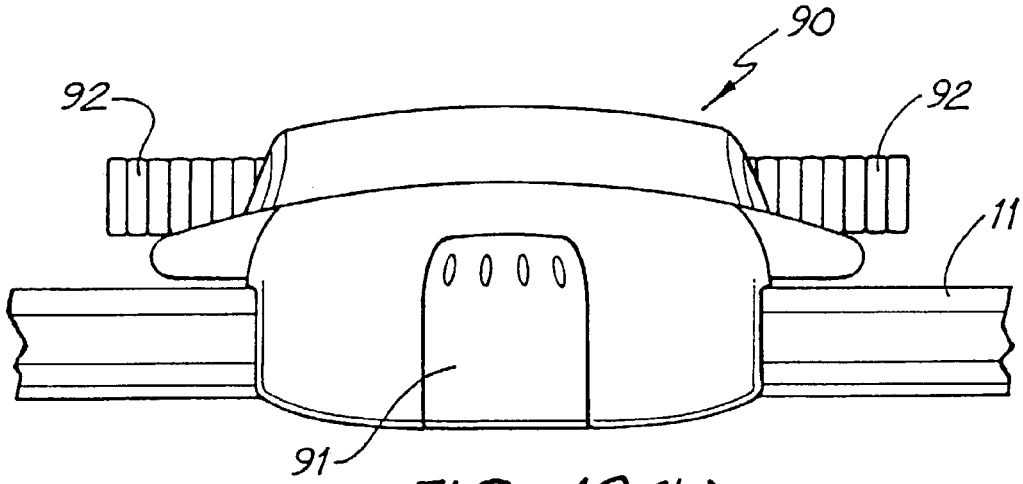

FIGS. 13(*a*) and (*b*) illustrate a device known as a split drive 90. The split drive is installed onto the rail 10 and includes a pair of resilient jaws 91. The split drive includes internal electronic components which allow the power and data from one source to be split so as to drive to different receiving objects. The device 90 can receive power and data through penetrating pins from the wires in a rail (see FIG. 10) onto which it is mounted. It can transmit data and power to one or two different rails or other split drives. Wires which enter or exit the split drive 90 may pass through output sleeves 92 conveniently located on the front of the device. In the alternative, a device can receive a power and data input through external wires entering through one of the sleeves 92, in which case the device then delivers this information and power to both the rail 10 on which it is fixed (via penetrating pins) and another split drive device or rail. In essence the split drive is a self configuring "T" connector for the network.

Figure 14:
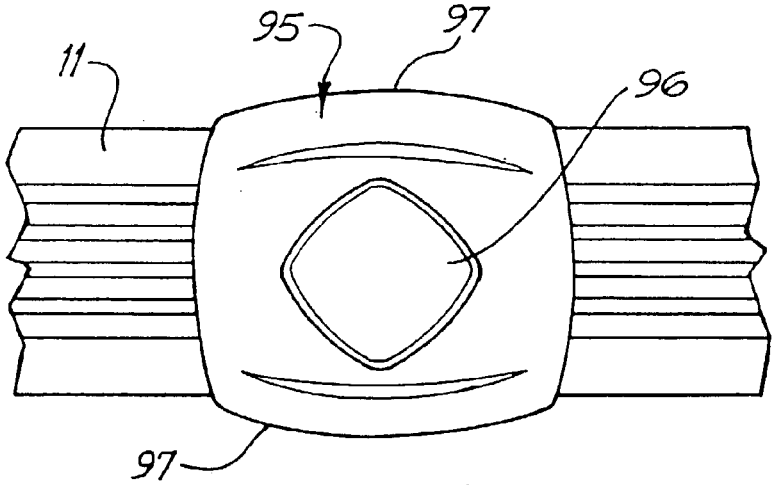
FIG. 14 is a front view of a pick light device.
Figure 15A:
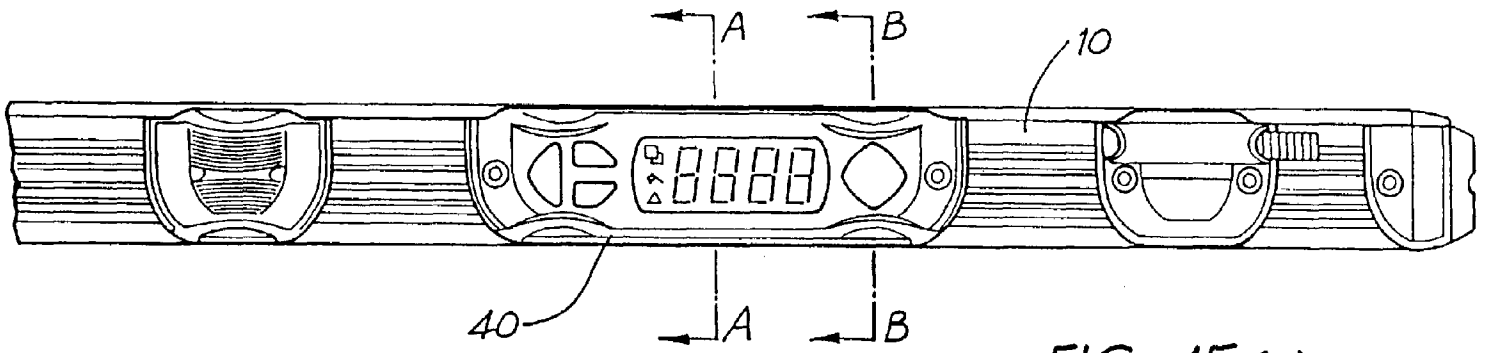
FIG. 15(*a*) is a front view of a further preferred embodiment of the support rail and data device according to the present invention.
Figure 15B:
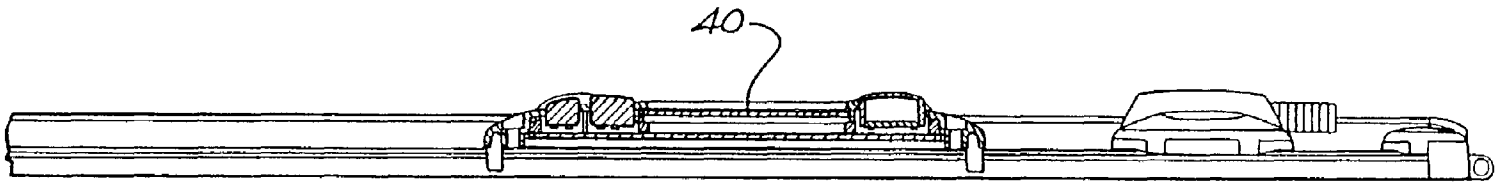
Figure 15C:
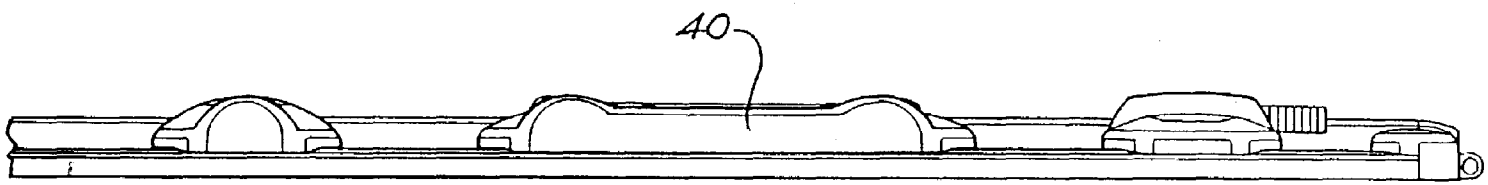
Figure 15E:
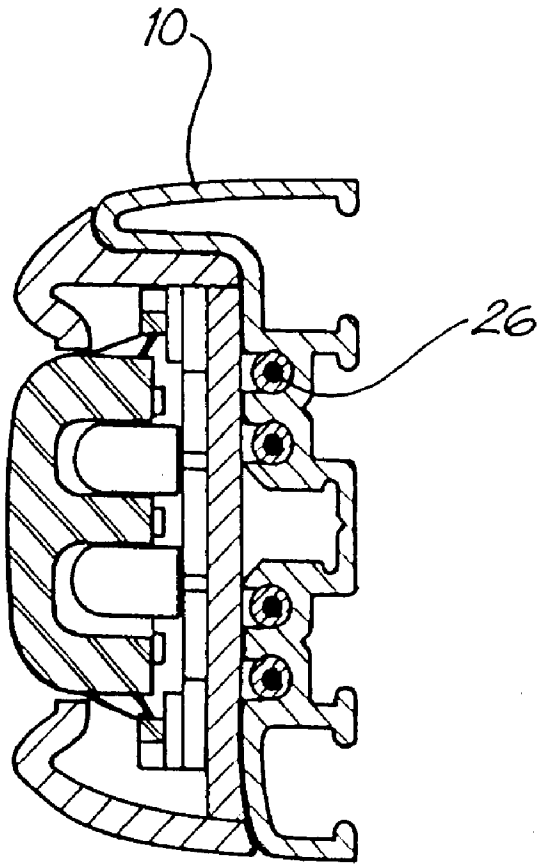
Figure 15D:
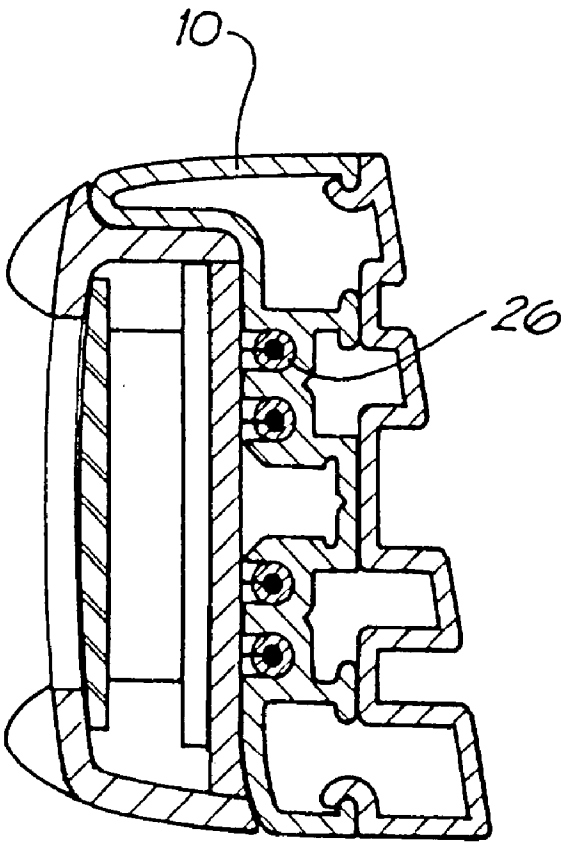
Figure 16A:
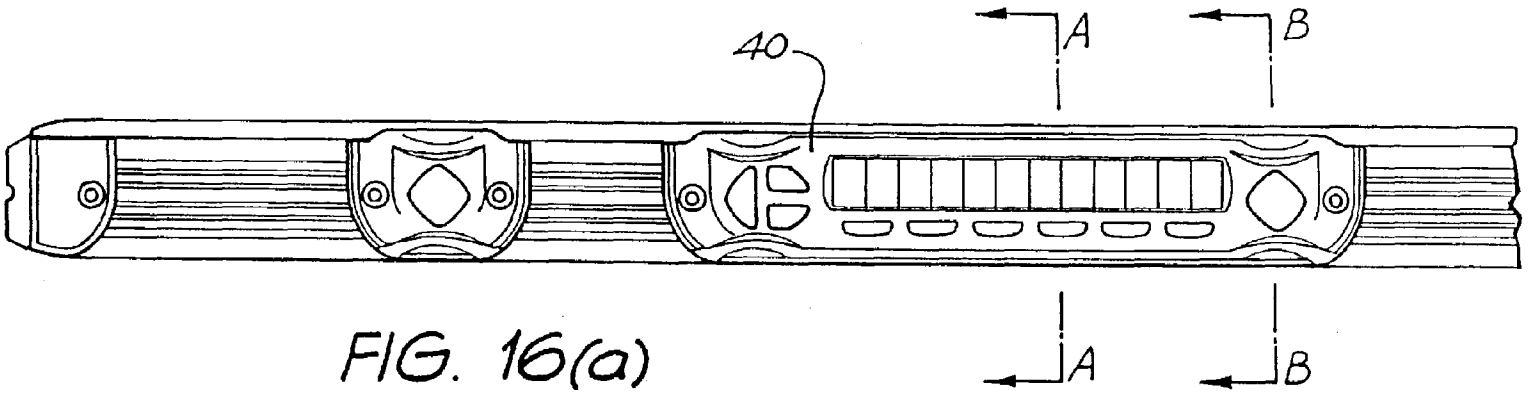
FIG. 16(*a*) is a front view of a further preferred embodiment of the support rail and data device according to the present invention.
Figure 16B:
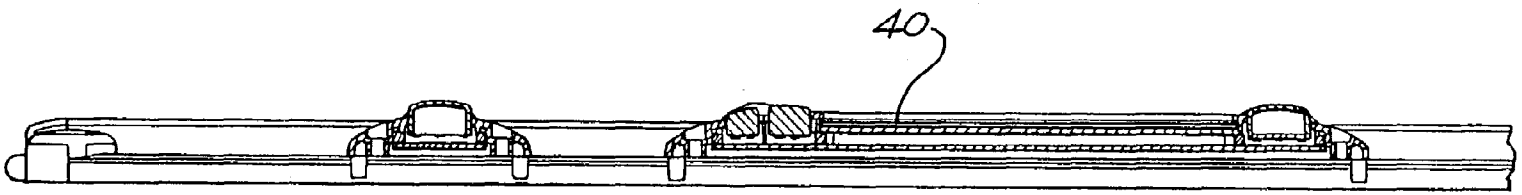
Figure 16C:
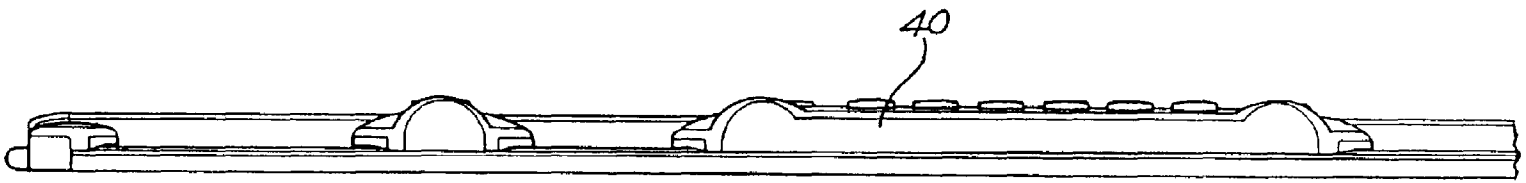
Figure 16F:
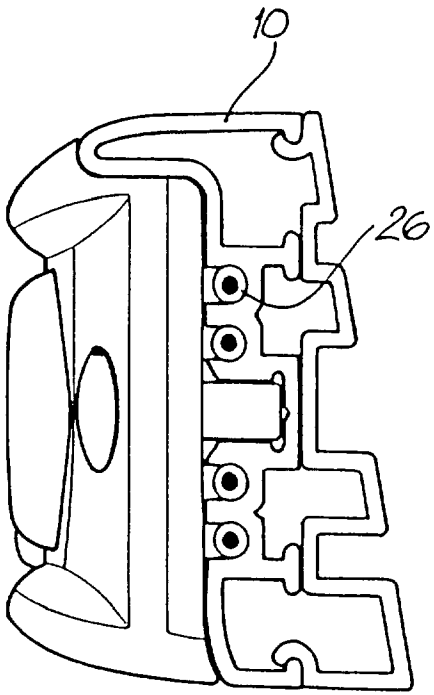
Figure 16E:
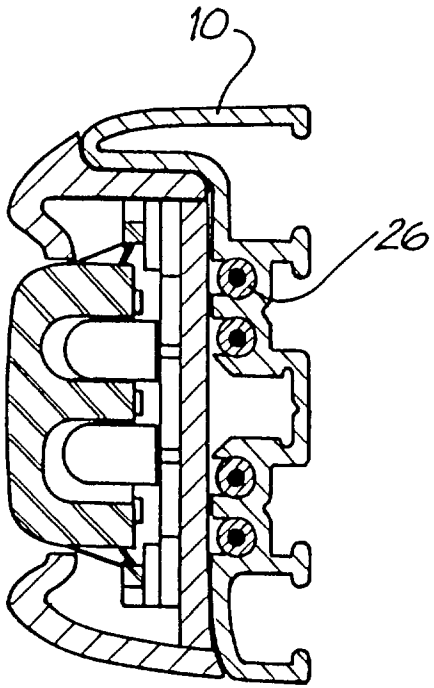
Figure 16D:
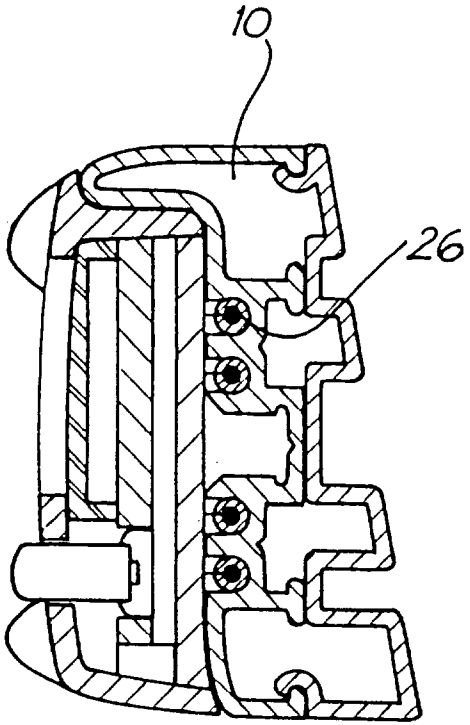

FIG. 14 displays a simple location level picking device 95 which includes a flashing indicator button 96. The device affixes to the rail in the same way as the other devices in this family (see FIG. 10) and also includes a single set of resilient jaws 97 for preventing inadvertent disconnection from the rail.

FIGS. 15(*a*) to 15(*e*) and FIGS. 16(*a*) to 16(*f*) depict various views of further alternative embodiments of the present invention. For ease of reference, those features in common with the other embodiments of the invention previously discussed have been given the same reference numerals.

In the preferred embodiments of FIGS. 15(*a*) to 15(*c*) and FIGS. 16(*a*) to 16(*f*), it should be noted that the support rail includes an upper surface which extends outwardly from the body of the rail. Additionally, the upper surface of the rail and the upper portion of the device are radiused. In this way, a degree of shielding and protection is provided to the device. This form of the invention is particularly preferable in applications where the support rail and device may be prone to being struck by, for example, objects falling from shelves above the rail.

While the aforementioned devices have been disclosed with reference to particular details of construction, this should be understood as having been provided by way of example only and not as limitations to the scope and spirit of the invention. The specific examples provided here regarding rail asymmetry and non-invertible coupling with devices should be seen as an example of asymmetrical rail design. Further, the specific functions performed by the family of devices disclosed here should also not be seen as a limitation to the scope of the family of such devices as may be employed in such a picking system.

The invention claimed is:

1. A paperless picking system, comprising:

multiple bays of product supports;

operator interface devices at said multiple bays, said operator interface devices comprising at least one chosen from data displays and pick confirmation input devices;

a picking data management computer system receiving data from said pick confirmation input devices and providing data to said data displays;

a plurality of mounting rails, each mounted at one of said product supports at one of said multiple bays, said mounting rails supporting at least one data line;

each of said operator interface devices comprising a housing that is removably supported by one of said mounting rails, wherein electrical connection being established between said operator interface devices and said at least one data line as a result of said housing being supported by one of said mounting rails; and wherein said at least one data line provides data exchange between said data management computer system and said operator interface devices throughout a range of physical locations of said operator interface devices on said mounting rails and wherein the paperless picking system is configured by manually removing said operator interface devices from said mounting rails at particular physical locations and supporting said operator interface devices with said mounting rails at other physical locations.

2. The paperless picking system of claim 1 wherein said operator interface devices comprise at least one chosen from zone level devices, bay level devices and location level devices.

3. The paperless picking system of claim 1 wherein said at least one data line further supplies power and ground to said operator interface devices.

4. The paperless picking system of claim 1 wherein said data displays comprise at least one display device chosen from an LED, an LCD and a back-lit LCD.

5. The paperless picking system of claim 1 wherein said at least one data line comprises a plurality of data lines.

6. The paperless picking system of claim 1 wherein at least one of said housing and said mounting rails include a retention member for securing said housing to one of said mounting rails.

7. A paperless picking system comprising:

multiple bays of product supports;

operator interface devices at said multiple bays, said operator interface devices comprising at least one chosen from data displays and pick confirmation input devices;

a picking data management computer system receiving data from said pick confirmation input devices and providing data to said data displays;

a plurality of mounting rails, each mounted at one of said product supports at one of said multiple bays, said mounting rails supporting at least one data line, said at least one data line made up of an electrical conductor and insulation for said electrical conductor;

each of said operator interface devices comprising a housing that is removably supported by one of said mounting rails, each of said operator interface devices further comprising at least one electrical terminal extending from said housing, said at least one terminal extending past said insulation and contacting said at least one data line when said housing is supported by one of said mounting rails; and wherein said at least one data line provides data exchange between said data management computer system and said operator interface devices on said mounting rails throughout a range of physical locations of said operator interface devices and wherein the paperless picking system is configured by manually removing said operator interface devices from said mounting rails at particular physical locations and supporting said operator interface devices with said mounting rails at other physical locations.

8. The paperless picking system of claim 7 wherein said operator interface devices comprise at least one chosen from zone level devices, bay level devices and location level devices.

9. The paperless picking system of claim 7 wherein said at least one data line further supplies power and ground to said operator interface devices.

10. The paperless picking system of claim 7 wherein said data displays comprise at least one display device chosen from an LED, an LCD and a back-lit LCD.

11. The paperless picking system of claim 7 including a plurality of electrical conductors and insulation for said electrical conductors and wherein said at least one electrical terminal comprises a plurality of electrical terminals corresponding to said electrical conductors.

12. The paperless picking system of claim 11 wherein said mounting rails define a plurality of longitudinally spaced apart channels and wherein said electrical conductors and said insulation are supported in said channels.

13. The paperless picking system of claim 7 wherein at least one of said housing and said mounting rails include a retention member for securing said housing to one of said mounting rails.

* * * * *